US010307879B2

(12) United States Patent
Haas

(10) Patent No.: US 10,307,879 B2
(45) Date of Patent: Jun. 4, 2019

(54) DEVICE AND METHOD FOR THE FINISHING MACHINING OF AN INTERNAL FACE OF A WORKPIECE

(71) Applicant: Supfina Grieshaber GmbH & Co. KG, Wolfach (DE)

(72) Inventor: Alfons Haas, Sankt Roman/Wolfach (DE)

(73) Assignee: SUPFINA GRIESHABER GMBH & CO. KG, Wolfach (DE)

( * ) Notice: Subject to any disclaimer, the term of this patent is extended or adjusted under 35 U.S.C. 154(b) by 279 days.

(21) Appl. No.: 15/297,166

(22) Filed: Oct. 19, 2016

(65) Prior Publication Data

US 2017/0106489 A1 Apr. 20, 2017

(30) Foreign Application Priority Data

Oct. 19, 2015 (DE) ..... 10 2015 220 319

(51) Int. Cl.
*B24B 5/10* (2006.01)
*B24B 5/40* (2006.01)
(Continued)

(52) U.S. Cl.
CPC ..... *B24B 5/40* (2013.01); *B24B 5/10* (2013.01); *B24B 19/02* (2013.01); *B24B 19/022* (2013.01);
(Continued)

(58) Field of Classification Search
CPC .... B24B 5/06; B24B 5/08; B24B 5/10; B24B 5/185; B24B 5/40; B24B 19/02; B24B 19/022; B24B 19/03; B24B 19/06; B24B 33/02; B24B 33/022; B24B 33/027; B24B 33/05; B24B 47/02; B24B 47/10;
(Continued)

(56) References Cited

U.S. PATENT DOCUMENTS 2,489,437 A * 11/1949 Sandoz ..... B23Q 11/127 29/DIG. 67
4,512,107 A * 4/1985 Jones ..... B24B 35/00 451/160

(Continued)

FOREIGN PATENT DOCUMENTS

DE 4035374 A1 5/1991
DE 102010020814 A1 11/2011

*Primary Examiner* — Timothy V Eley
(74) *Attorney, Agent, or Firm* — Leydig, Voit & Mayer, Ltd.

(57) ABSTRACT

Device and method for the finishing machining of an internal face of a workpiece, such as the track of a ball screw, including a workpiece holder and a finishing tool held on a finishing tool holder. A rotary drive is provided, by which the workpiece holder and the finishing tool is rotationally driven relative to one another about a rotational axis. A linear drive is provided, by which the finishing tool held on the finishing tool holder and the workpiece holder is driven in a translatory manner relative to one another along the rotational axis. An oscillating drive is provided, by which the finishing tool held on the finishing tool holder and the workpiece holder is driven in an oscillating manner relative to one another in the direction parallel to the rotational axis and wherein the finishing tool is pivotably held on the finishing tool holder about a pivot axis.

12 Claims, 7 Drawing Sheets

(51) Int. Cl.

| | |
|---|---|
| ***B24B 19/02*** | (2006.01) |
| ***B24B 19/06*** | (2006.01) |
| ***B24B 33/02*** | (2006.01) |
| ***B24B 47/02*** | (2006.01) |
| ***B24B 55/02*** | (2006.01) |

(52) U.S. Cl.
CPC ..... *B24B 19/06* (2013.01); *B24B 33/022* (2013.01); *B24B 33/027* (2013.01); *B24B 47/02* (2013.01); *B24B 55/02* (2013.01)

(58) Field of Classification Search
CPC ..... B24B 47/14; B24B 47/20; B24B 55/02; B24B 55/03
See application file for complete search history.

(56) References Cited

U.S. PATENT DOCUMENTS 4,860,501 A * 8/1989 Belthle ..... B23G 1/36 451/48
5,170,590 A 12/1992 Sato et al.
5,586,469 A * 12/1996 Mitani ..... B24B 19/022 74/424.86
5,702,294 A * 12/1997 Baltazar et al. ..... B24B 19/02 451/541
6,546,992 B2 * 4/2003 Reusset ..... B22D 11/057 164/121
6,616,508 B1 * 9/2003 Kawamura ..... B24B 5/10 451/21
6,663,471 B2 * 12/2003 Kawamura ..... B24B 1/00 451/209
6,687,566 B2 * 2/2004 Nishimoto ..... B23G 1/38 409/66
6,716,088 B2 * 4/2004 Jinbu ..... B24B 19/02 451/180
6,726,544 B2 * 4/2004 Ozaki ..... B24B 5/14 451/163
7,238,089 B2 * 7/2007 Tsumuraya ..... B24B 5/40 451/41
8,341,844 B2 * 1/2013 Tsukamoto ..... B24B 5/06 29/898.066
8,647,175 B2 * 2/2014 Schmitz ..... B24B 35/00 451/284
9,022,837 B2 * 5/2015 Pohlitz ..... B24B 33/04 451/210
2009/0165274 A1 * 7/2009 Sensui ..... B24B 19/06 29/33 R
2011/0287695 A1 11/2011 Schmitz et al.

* cited by examiner

DEVICE AND METHOD FOR THE FINISHING MACHINING OF AN INTERNAL FACE OF A WORKPIECE

CROSS-REFERENCE TO PRIOR APPLICATION

Priority is claimed to German Patent Application No. DE 10 2015 220 319.0, filed on Oct. 19, 2015, the entire disclosure of which is hereby incorporated by reference herein.

FIELD

The invention relates to a device and method for the finishing machining of an internal face of a workpiece, in particular the track of a ball screw.

BACKGROUND

Prior art devices and methods regarding the above are known from DE 10 2010 020 814 A1 and DE 40 35 374 A1. In the known devices, the finishing tool is held on a U-shaped tool holder, which can be driven in an oscillating manner about an axis of oscillation. The drawback in the known devices is that a thread length measured along the rotational axis of the workpiece, along which an internal face can be machined in a finishing manner, is limited and predetermined by the length of the U-shaped tool holder. It is furthermore disadvantageous that, depending on an insertion depth of the finishing tool measured along the rotational axis of the workpiece, the maximum possible angles of oscillation of the workpiece holder are limited.

Proceeding from this, the present invention is based on the object of providing a device and a method of the type mentioned at the outset, with which the above-mentioned drawbacks are avoided.

SUMMARY

This object is achieved according to the invention in a device wherein an oscillating drive is provided, by means of which the finishing tool held on the finishing tool holder and the workpiece holder can be driven in an oscillating manner relative to one another in the direction parallel to the rotational axis and that the finishing tool is pivotably held on a finishing tool holder about a pivot axis.

In a method of the type mentioned at the outset, the object is achieved according to the invention in that the finishing tool held on the finishing tool holder and the workpiece held on the workpiece holder are driven in an oscillating manner relative to one another in the direction parallel to the rotational axis, superimposed on the rotational movement and the translatory movement, and that the finishing tool is pivoted about a pivot axis relative to the finishing tool holder.

According to the invention, an oscillating drive is provided, which serves to move the finishing tool held on the finishing tool holder, on the one hand, and the workpiece holder or the workpiece held on the workpiece holder, on the other hand, relative to one another in an oscillating manner, specifically in a direction parallel to the rotational axis of the workpiece holder or the workpiece. This means that a further linear oscillating movement is superimposed on the translatory movement between the finishing tool and workpiece. The finishing tool is in turn pivotably mounted on the finishing tool holder, so the finishing tool carries out a pivoting movement relative to the internal face to be machined in a finishing manner.

In relation to a central rest pivoting position, preferred maximum pivoting angles are between +/−1° (corresponds to a total pivoting angle of 2°) and +/−15° (corresponds to a total pivoting angle of 30°).

The device according to the invention and the method according to the invention allow angles of oscillation of the finishing tool that are independent of an insertion depth into the workpiece to be selectable. Moreover, a finishing tool holder extending substantially exclusively parallel to the rotational axis of the workpiece holder can be used, so the machining of workpieces with long threads is substantially simplified.

The device according to the invention and the method according to the invention have the further advantage that position errors between the workpiece and finishing tool can be compensated by resting the finishing tool on the internal face of the workpiece and by the pivotability of the finishing tool.

In the framework of the present invention, the internal face of a workpiece is taken to mean a groove-shaped indentation in profile, the course of which corresponds to a helix. The internal face is, in particular, a track pointing radially inwardly of a ball screw or the internal thread of a thread pairing.

It is possible that the finishing tool, for example a finishing block, is directly pivotably held on the finishing tool holder. In a preferred embodiment, however, a finishing tool receiver is provided, in which the finishing tool, in particular a finishing block, is received, the finishing tool receiver being pivotably held on the finishing tool holder about the pivot axis.

The finishing tool receiver preferably comprises a receiving region for the finishing tool, in which the finishing tool is displaceably received. A finishing tool subject to wear can thus be adjusted.

The pivot axis of the finishing tool or the assembly, comprised of the finishing tool and finishing tool receiver, preferably runs perpendicular to the rotational axis of the workpiece holder and the workpiece held on the workpiece holder. It is thus possible for the pivot axis and the rotational axis to intersect. These axes may, however, also be arranged in a skew manner, in other words spaced apart from one another.

In a preferred embodiment of the invention, a locking mechanism is provided, by means of which a rest pivoting position of the finishing tool is predetermined. The finishing tool can thus be held in a defined position, which is advantageous, in particular, in setting up processes, in other words, for example, when the finishing tool is to be brought with an active face to engage with an internal face of a workpiece to be machined. The locking mechanism cooperates with the finishing tool and/or with the finishing tool receiver and comprises, for example, locking springs supported in the finishing tool holder.

The locking mechanism can advantageously be released (in particular without a tool), so a finishing tool or an assembly, consisting of a finishing tool and finishing tool receiver, can be separated from the finishing tool holder without a tool and replaced by a new finishing tool or a new assembly. As a result tool exchanges can be carried out particularly quickly and easily.

In a further preferred embodiment of the device, a cooling lubricant supply mechanism is provided. The cooling lubricant provided by a mechanism of this type can be exclusively used in a conventional manner to cool an engagement region between the finishing tool and workpiece and/or to lubricate it. As an alternative or in addition to this it is, however, very advantageous if the cooling lubricant is active as a sliding medium, specifically for a finishing tool displaceably arranged in a finishing tool receiver, in particular a finishing block.

It is furthermore particularly preferred if the device comprises a pressing mechanism, which loads the finishing tool with a pressing force to press an active face of the finishing tool against the internal face.

It is possible in the framework of the invention for the pressing force to be produced by a mechanical, electrical, hydraulic or pneumatic drive, which loads the tool holder with a pressing force so the pressing force is transmitted by the tool holder, optionally with the interposition of a finishing tool receiver, onto the finishing tool and therefore onto the active face of the finishing tool.

It is possible in the framework of the invention for the pressing mechanism to comprise a pressurized fluid for transmitting a pressing force. A fluid of this type has the advantage that a pressing force can also easily be transmitted across complicated geometries.

In a particularly preferred embodiment of the invention, the pressurized fluid is a cooling lubricant. The finishing tool can thus be loaded with a pressing force by means of the cooling lubricant, with the cooling lubricant simultaneously being able to have other functions, in particular the cooling and/or lubrication of an engagement region of the finishing tool with the internal face and/or as a sliding medium for a finishing tool displaceably arranged in a finishing tool receiver.

In order to be able to load the fluid with a specific pressure, it is preferred if the device comprises a regulating mechanism, with which the pressure of the cooling lubricant of a cooling lubricant supply mechanism can be regulated.

One aspect of the invention provides a device for the finishing machining of an internal face of a workpiece, including a workpiece holder and a finishing tool holder. A finishing tool is held on the finishing tool holder. A rotary drive is configured to rotationally drive the workpiece holder and the finishing tool relative to one another about a rotational axis. A linear drive is configured to drive in a translatory movement the finishing tool held on the finishing tool holder and the workpiece holder relative to one another along the rotational axis. An oscillating drive is configured to oscillatingly drive the finishing tool held on the finishing tool holder and the workpiece holder relative to one another in the direction parallel to the rotational axis and the finishing tool is pivotably held on the finishing tool holder about a pivot axis.

Another aspect of the invention provides a method for the finishing machining of an internal face including holding a workpiece on a workpiece holder and holding a finishing tool on a finishing tool holder. The workpiece and the finishing tool are driven rotationally relative to one another about a rotational axis. The finishing tool and the workpiece are driven in a translatory movement relative to one another along the rotational axis. The finishing tool and the workpiece are driven in an oscillating movement relative to one another in the direction parallel to the rotational axis, the oscillating movement superimposed on the rotational movement and the translatory movement. The finishing tool is pivoted relative to the finishing tool holder about a pivot axis.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
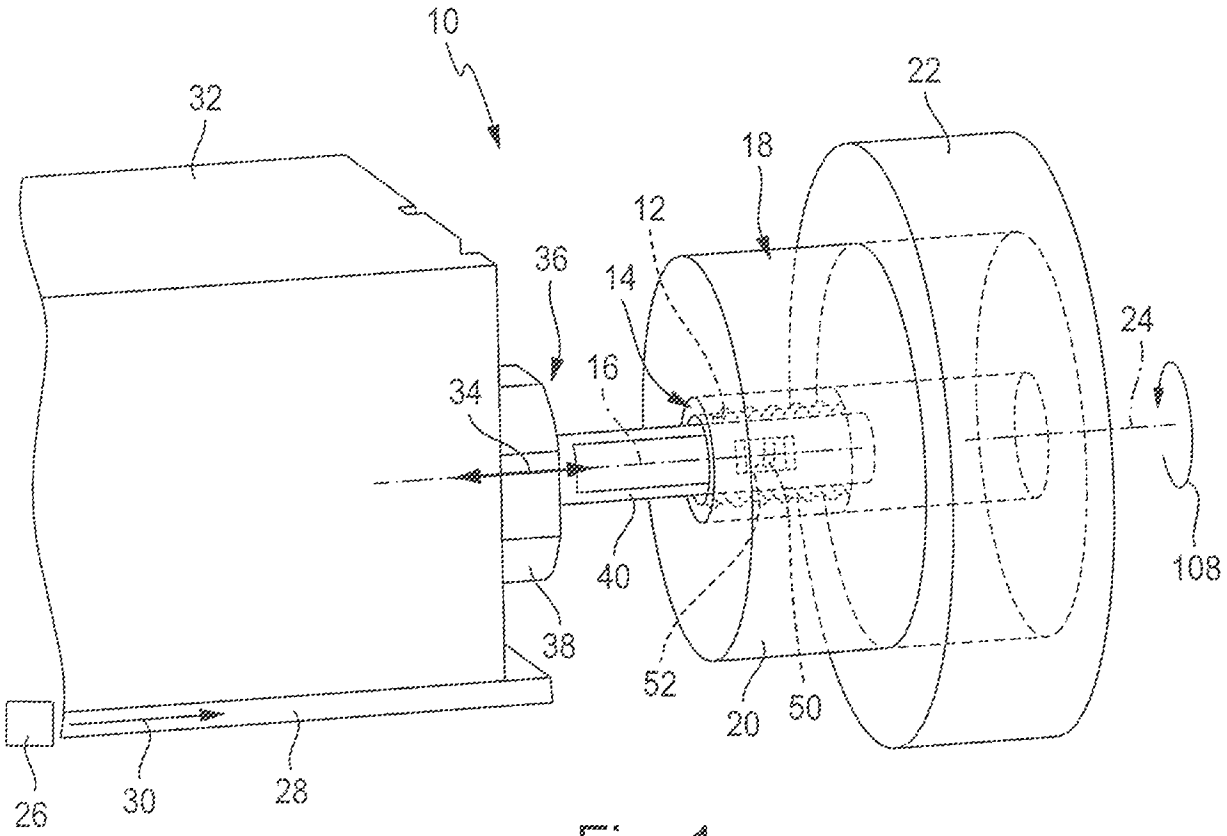
FIG. 1 is a perspective view of an embodiment of a device for the finishing machining of an internal face of a workpiece.

FIG. 1 shows an embodiment of a device 10 for the finishing machining of an internal face 12 of a workpiece 14.

The internal face 12 is, in particular, the track of a ball screw. The internal face 12 is pitch circle-like or arcuate in profile. The internal face 12 extends in a helix-like manner (helically) at least along a part of a length of the workpiece 14 measured parallel to a workpiece axis 16.

The device 10 comprises a workpiece holder 18, which may be configured, for example, as a chuck 20. The workpiece holder 18 is connected to a rotary drive 22, by means of which the workpiece holder 18 and the workpiece 14 can be rotationally driven about a rotational axis 24.

The device 10 furthermore comprises a linear drive 26, which serves to drive a slide 28 in the direction parallel to the rotational axis 24, for example in a direction 30 in the direction of the workpiece holder 18 and opposite thereto.

The slide 28 is used for fastening an oscillating drive 32, which, relative to the slide 28, produces an oscillating movement 34 also running parallel to the rotational axis 24. The oscillating drive 32 is connected to a finishing tool holder 36. The finishing tool holder 36 comprises a connecting portion 38 for connection to a housing of the oscillating drive 32. Furthermore, the finishing tool holder 36 comprises an arm 40 extending parallel to the rotational axis 24. The arm 40 has a straight course and is slim enough to be able to be inserted in a space of the workpiece 14 surrounded by the internal face 12.

The finishing tool holder 40 has a pivot bearing 42 (cf. FIG. 3), which defines a pivot axis 44. The pivot axis 44 runs perpendicular to the rotational axis 24 (cf. FIG. 2).

The device 10 furthermore comprises a finishing tool 46 in the form of a finishing block 48. The finishing tool 46 has an active face 50, which is preferably curved and can be brought into engagement with the internal face 12 of the workpiece 14 (cf. FIG. 2). In this case, the active face 50 is oriented inclined in accordance with the thread pitch of the internal face 12.

A finishing tool receiver 52 is provided for mounting the finishing tool 46 on the arm 40 of the finishing tool holder 36. The finishing tool receiver 52 has bearing bolts 54, which cooperate with the pivot bearing 42 of the arm 40. The finishing tool 46 is thus pivotably mounted on the finishing tool holder 36 about the pivot axis 44. The finishing tool receiver 52 is arranged in a central recess 56 of the arm 40.

The tool holder 36 is preferably hollow so cooling lubricant can be supplied from an access 58 to the finishing tool 46.

The access 58 cooperates with a channel 60, which runs in the radial direction and opens on a central channel 62. The central channel 62 extends within the arm 40 to a limitation 64, which is arranged adjacent to the recess 56.

For the active fluid connection between the channel 62 and the recess 56, in which the finishing tool receiver 52 is arranged, the channel 62 has, adjacent to or in the region of the limitation 64, a passage 66, through which fluid can be guided out of the channel 62 onto the outside of the arm 40. An overflow region 68 leading up to the recess 56 is preferably provided on the outside of the arm 40.

As the finishing tool receiver 52 is spaced apart from the edging of the recess 56, cooling lubricant can flow past the finishing tool receiver 52 to the active face 50, so the workpiece surface to be machined, in other words the internal face 12, can be supplied with cooling lubricant.

Figure 6:
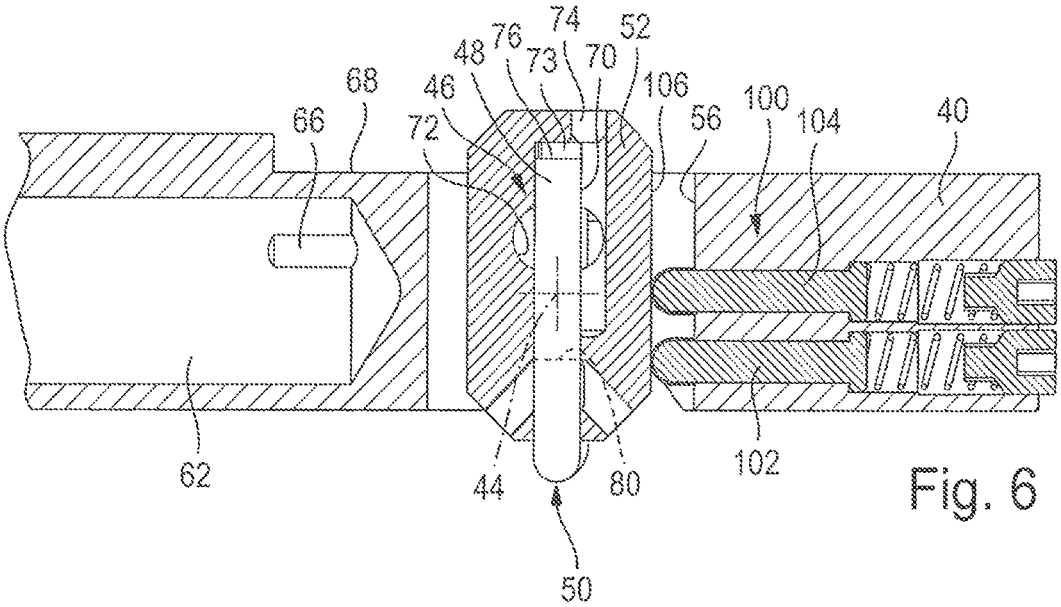
FIG. 6 is the longitudinal section of the finishing tool holder, the finishing tool receiver and the finishing tool of the device according to FIG. 1, wherein the finishing tool adopts a rest pivoting position.
Figure 7:
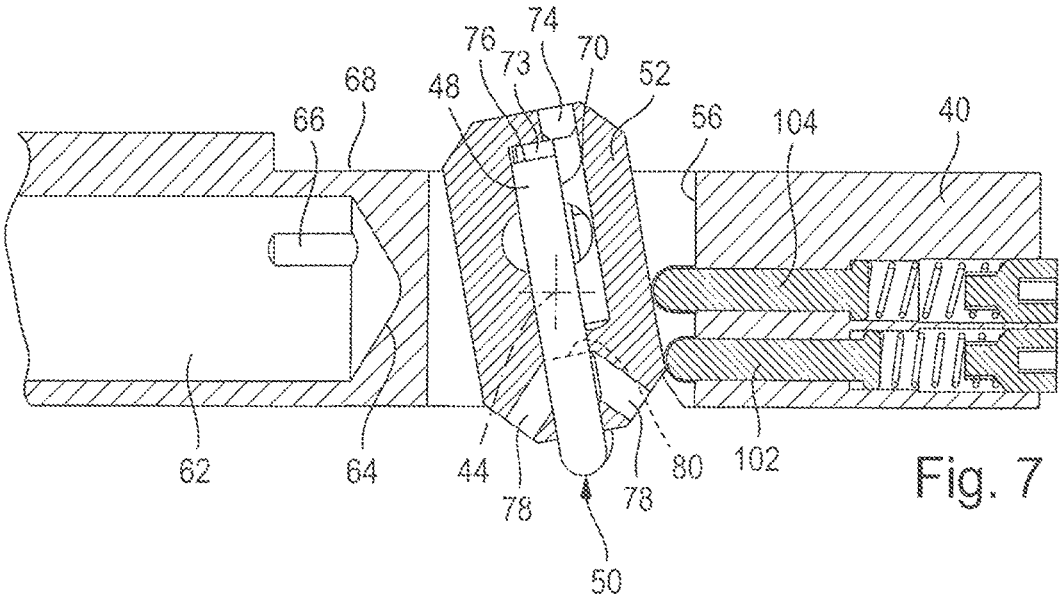
FIG. 7 is a longitudinal section corresponding to FIG. 5, wherein the finishing tool adopts a pivoting position deflected from the rest pivoting position.

Reference will be made below to FIGS. 6 to 7. The finishing tool receiver 52 has a receiving region 70, in which the finishing tool 46 is slidingly displaceably arranged. The receiving region 70, at least at the level of an approximately centrally arranged opening region 72, is open toward the outside of the finishing tool holder 52 so cooling lubricant, which is arranged in the recess 56, can arrive at the receiving region 70 through the opening region 72. The cooling lubricant can thus serve as a sliding medium for the finishing tool 46 received in the receiving region 70.

The finishing tool receiver 52 furthermore has a pressure chamber 73, which is fed with cooling lubricant from the recess 56 via connecting channels 74. When the cooling lubricant present in the pressure chamber 73 is loaded with pressure, the pressure acts on a head face 76 of the finishing tool 46. The head face 76 is arranged on the end of the finishing tool 46 that is spaced apart from the active face 50.

The finishing tool receiver 52, at its end remote from the pressure chamber 73, has overflow lines 78. These are flooded with cooling lubricant from the pressure chamber 73 when the finishing tool 46 has shortened to such an extent that the head face 76 is arranged below a level 80 defined by the overflow lines 78.

An active fluid coupling of the pressure chamber 73 and the overflow lines 78 leads to a pressure drop of the cooling lubricant, which can easily be detected by means of a sensor. This allows the easy detection of a state of a worn-out finishing tool 46, which has to be exchanged for a new finishing tool 46.

Figure 5:
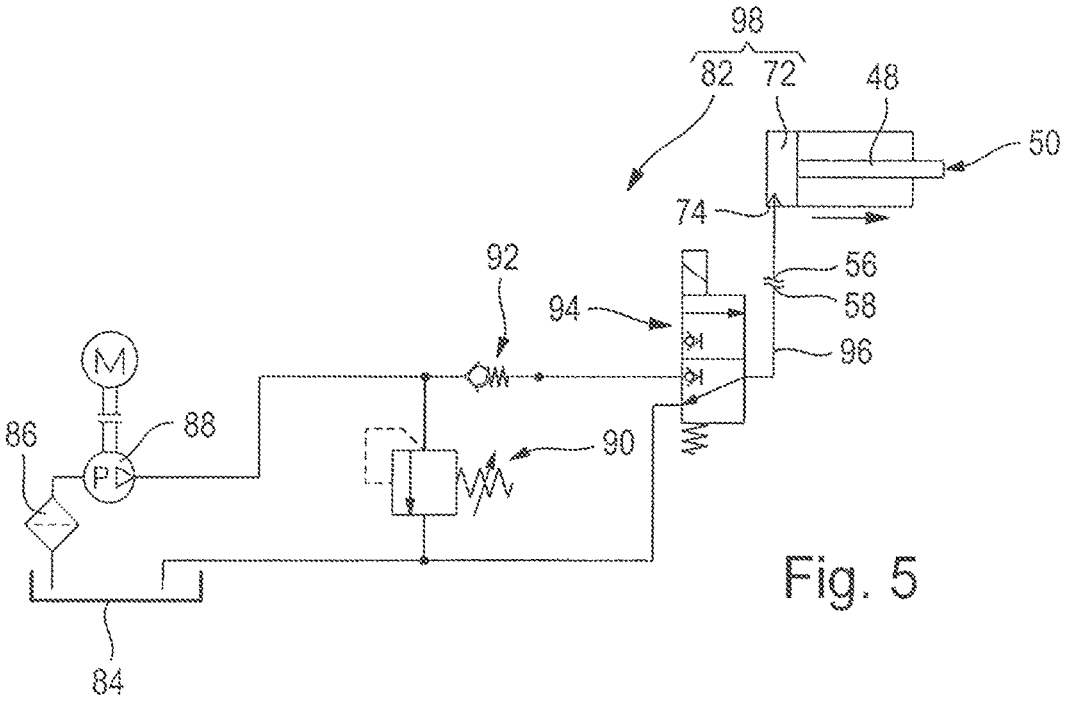
FIG. 5 is a schematic view of a cooling lubricant supply mechanism of the device according to FIG. 1.

In order to be able to supply the pressure chamber 73 with pressurized cooling lubricant, the device 10 comprises a cooling lubricant supply mechanism 82 shown schematically in FIG. 5. This comprises a reservoir 84, a filter mechanism 86 and a pump 88, furthermore a pressure-control valve 90, a check valve 92 and a 3/2-way valve 94. The valve 94 communicates with a line 96 leading to the supply line 58 of the finishing tool holder 36. The cooling lubricant then arrives in the manner described above in the recess 56 and from there via the connecting channels 74 into the pressure chamber 73.

The cooling lubricant supply mechanism 82, together with the pressure chamber 73, forms a pressing mechanism 98 for producing a pressing force, with which the active face 50 of the finishing tool 46 is pressed against the internal face 12 of the workpiece 14.

To define a rest pivoting position of the finishing tool holder 52 about the pivot axis 44, the device 10 comprises a locking mechanism designated in total by the reference numeral 100 (cf. FIG. 6). Said locking mechanism comprises at least one, preferably two, spring-loaded pins 102, 104, which are supported on one end of the arm 40 and project into the recess 56 and are in contact there with an outer face 106 of the finishing tool receiver 52.

Proceeding from the rest pivoting position (cf. FIG. 6) the finishing tool receiver 52 can be pivoted into deflected positions (cf. FIG. 7). This is accompanied by a relaxation of one of the spring pins 102, 104 and a compression of another of the spring pins 102, 104.

For a rapid exchange of a finishing tool 46, it is possible to displace a finishing tool receiver 52 together with a worn-out finishing tool 46 out of the pivot bearing 52, counter to the action of the spring pins 102, 104. Then a fresh finishing tool 46 held on a further finishing tool receiver 52 can be guided into the pivot bearing 42. In this case, the finishing tool receiver 52 is inclined in accordance with the shape of the pivot bearing 42 (cf. FIGS. 3 and 7). The locking mechanism 100 fixes the finishing tool receiver 52 in the recess 56 and transfers the finishing tool receiver 52 into the rest pivoting position (cf. FIG. 6).

Figure 2:
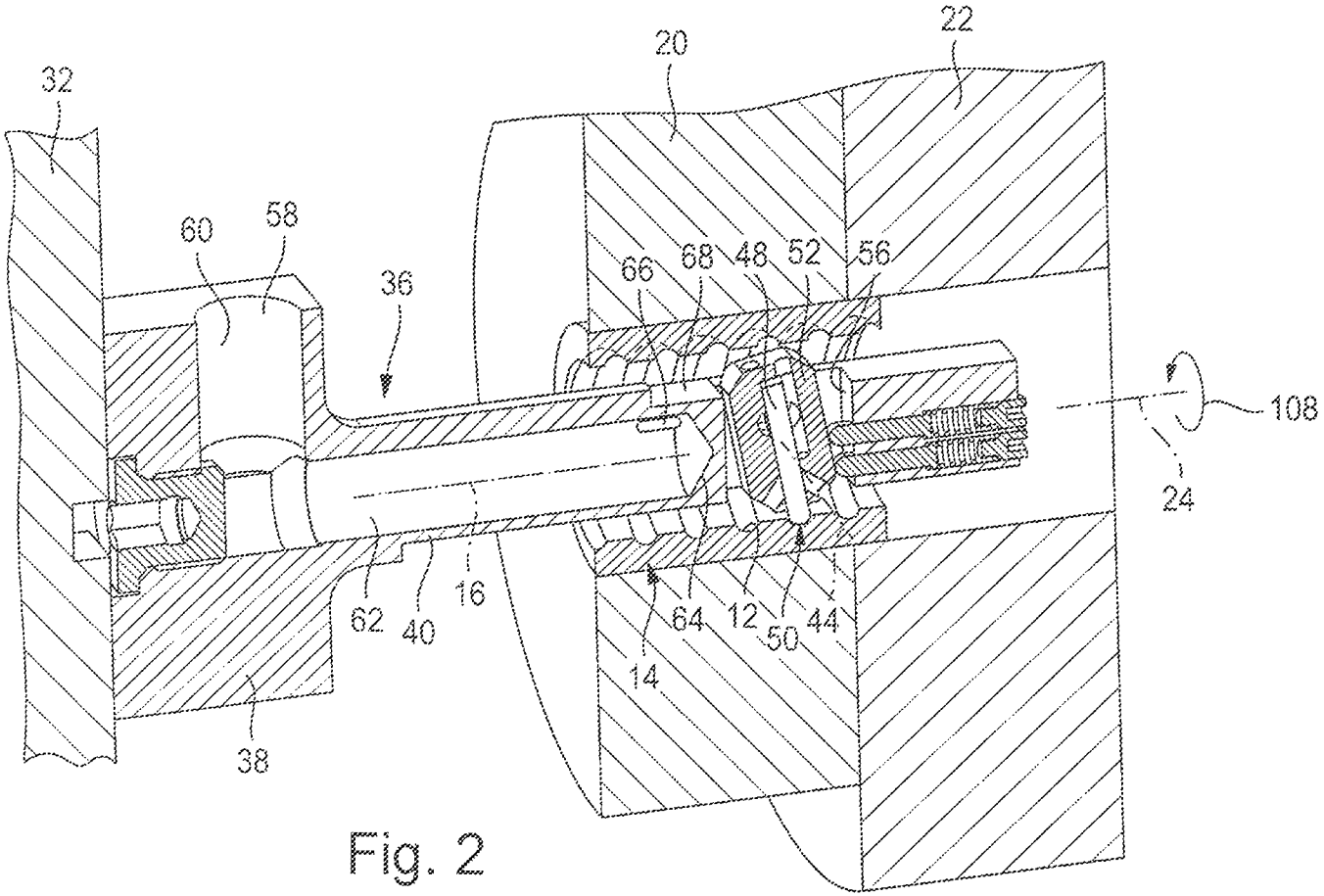
FIG. 2 is a perspective longitudinal section of the device according to FIG. 1.
Figure 3:
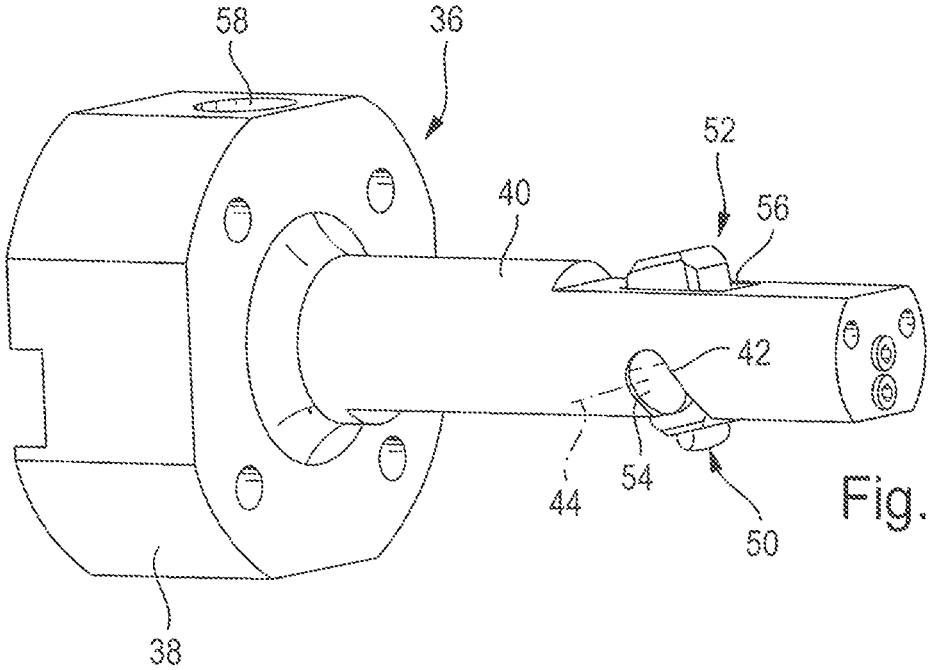
FIG. 3 is a perspective view of a finishing tool holder, a finishing tool receiver and a finishing tool of the device according to FIG. 1.
Figure 4:
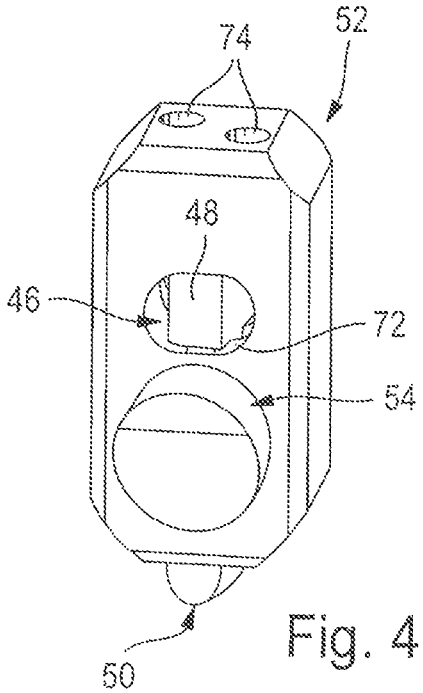
FIG. 4 is a perspective view of the finishing tool receiver and the finishing tool.

For the finishing machining of the internal face 12, the workpiece 14 is rotationally driven by means of the rotary drive 22 about the rotational axis 24 in the rotational direction 108 (cf. FIGS. 1 and 2). This rotational movement, in accordance with the pitch of the internal face 12, is superimposed by a translatory movement, with which the slide 28 is displaced parallel to the rotational axis 24 by means of the linear drive 26. Superimposed on these two movements, the finishing tool holder 36 is driven in an oscillating manner by means of the oscillating drive 32. The finishing tool holder 36, together with the finishing tool receiver 52 and the finishing tool 46, moves here in the direction parallel to the rotational axis 24. An oscillating frequency is typically between about 0.5 and 35 Hz. A typical amplitude of the oscillating movement is, for example, between about 0.2 and 5 mm.

Owing to the oscillating movement of the tool holder 36, the pivot axis 44 of the finishing tool 46 moves in the direction parallel to the rotational axis 24 relative to a portion of the internal face 12 that is about to be machined. A pivoting movement, in which the finishing tool and the finishing tool receiver 52 pivot back and forth about the pivot axis 44, is superimposed on this translatory movement as a result of the engagement of the curved active face 50 in the profile of the internal face 12.

The pressing force, with which the active face 50 of the finishing tool presses against the internal face 12, is determined by the pressure of the cooling lubricant, which is supplied to the pressure chamber 73 in the manner described above.

An angle, at which the finishing tool receiver 52 together with the finishing tool 46 is pivoted back and forth in the course of the machining of the internal face 12, is determined by the amplitude of the oscillating movement, which is in turn determined by the oscillating drive 32. The pivoting angle is freely selectable and can be set by setting the oscillating amplitude. This setting possibility is regardless of how deeply the arm 40 is inserted into the workpiece 40.

A further embodiment of a device 10 for the finishing machining of an internal face 12 of a workpiece 14 will be described below. In this case, reference is made to the above description of the device 10 according to FIG. 1 to 7. Only the differences between the devices 10 according to FIGS. 8 and 9 and according to FIG. 1 to 7 will be dealt with below.

Figure 8:
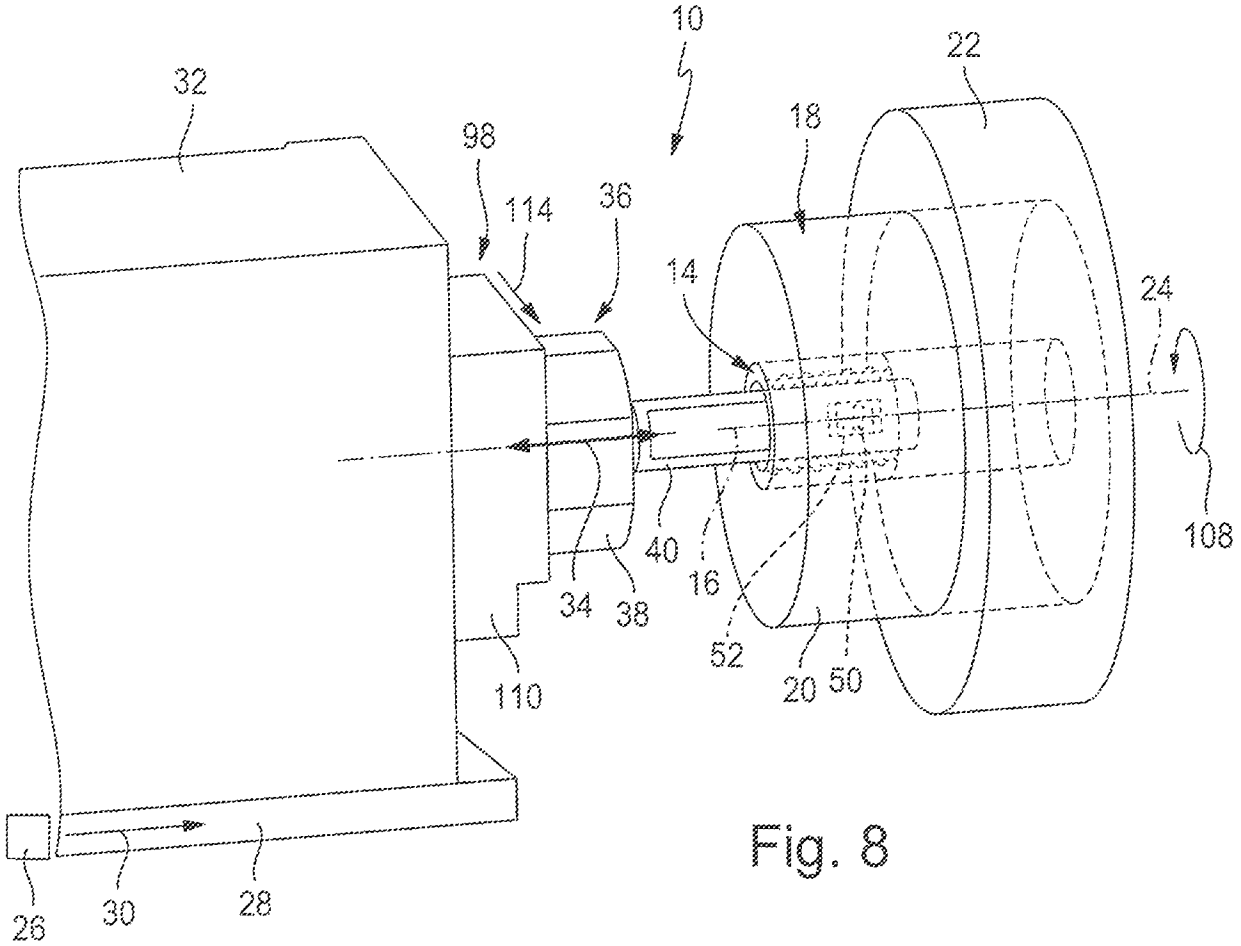
FIG. 8 is a perspective view of a further embodiment of a device for the finishing machining of an internal face of a workpiece.
Figure 9:
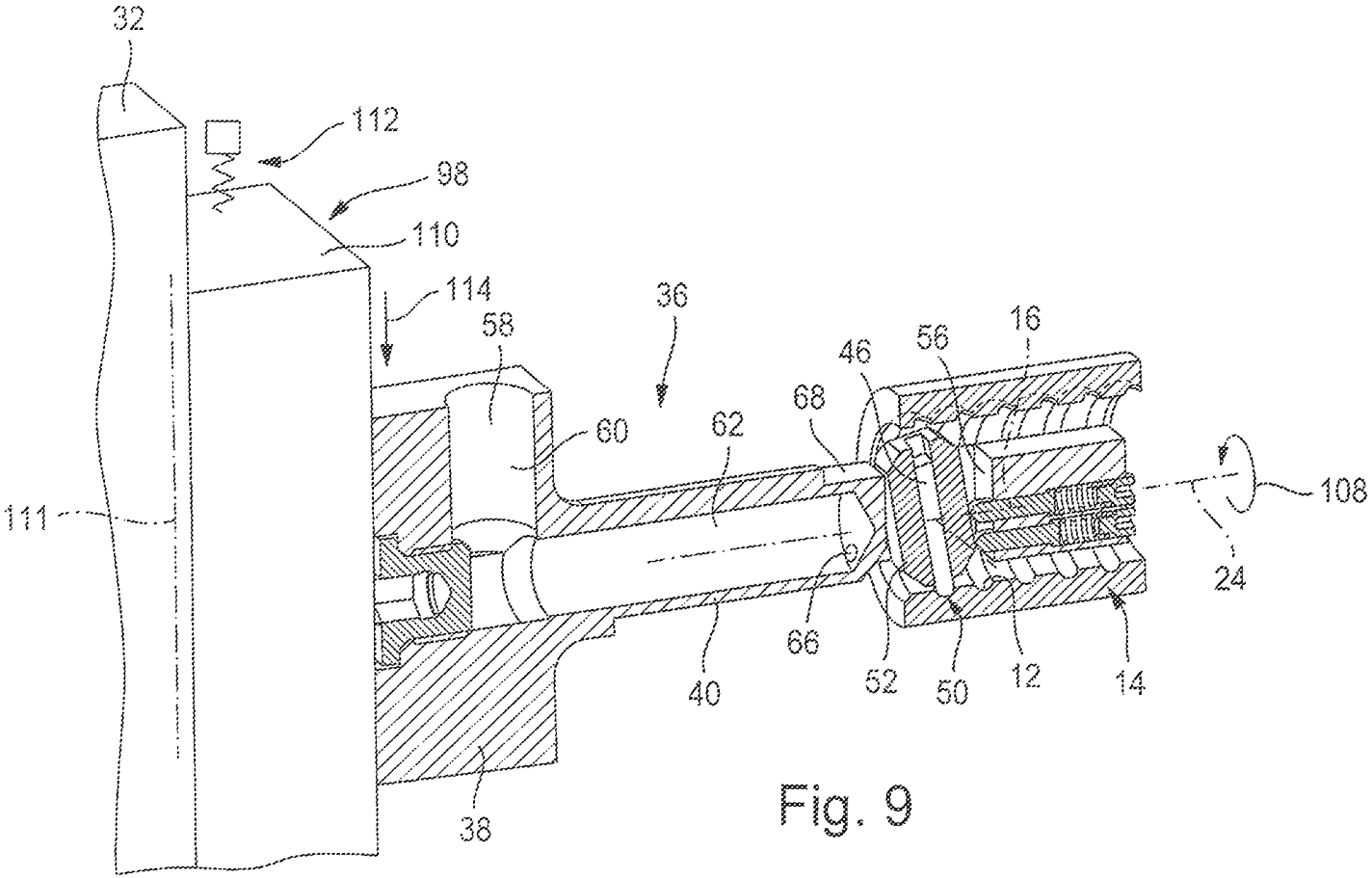
FIG. 9 is a perspective longitudinal section of the device according to FIG. 8.

A pressing mechanism 98, which is active between the oscillating drive 32 and the finishing tool holder 36, is provided in the device 10 according to FIGS. 8 and 9. The pressing mechanism 98 comprises a bearing unit 110, which is connected to the fastening portion 38 of the finishing tool holder 36 and can be displaced along a bearing axis 111 relative to a housing of the oscillating drive 32 (cf. FIG. 9).

The pressing mechanism 98 moreover comprises a pressing drive 112, schematically shown in FIG. 9, for producing a pressing force 114 also indicated in FIG. 8. The pressing drive 112 may, for example, be formed by a pneumatic cylinder.

The pressing force 114 runs perpendicular to a respective portion of the internal face 12 to be machined, in other words radially outwardly in relation to the workpiece axis 16 of a workpiece.

By means of the fastening portion 38 and the arm 40 and by means of the finishing tool receiver 52, the pressing force 114 is transmitted to the finishing tool 46 and therefore to the active face 50. It is therefore unnecessary in this case for the finishing tool 46 to be received in a sliding manner within the finishing tool receiver 52. Accordingly, the finishing tool receiver 52 may be configured as a simple clamping body (cf. FIG. 9).

To improve the supply of the machining point with cooling lubricant, it is preferred if the passage 66 at the end of the channel 62 (differing from the configuration according to FIG. 1 to 7) is arranged adjacent to the active face 50 of the finishing tool 46.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A device for the finishing machining of an internal face of a workpiece, comprising:

a workpiece holder;

a finishing tool holder;

a finishing tool held on the finishing tool holder;

a rotary drive configured to rotationally drive the workpiece holder and the finishing tool relative to one another about a rotational axis;

a linear drive configured to drive in a translatory movement the finishing tool held on the finishing tool holder and the workpiece holder relative to one another along the rotational axis, the translatory movement being in a direction parallel to the rotational axis;

an oscillating drive configured to oscillatingly drive the finishing tool held on the finishing tool holder and the workpiece holder relative to one another in the direction parallel to the rotational axis; and wherein the finishing tool is pivotably held on the finishing tool holder about a pivot axis.

2. The device according to claim 1, wherein the finishing tool is received in a finishing tool receiver and the finishing tool receiver is pivotably held on the finishing tool holder about the pivot axis.

3. The device according to claim 1, wherein the pivot axis is oriented perpendicular to the rotational axis.

4. The device according to claim 1, further comprising a locking mechanism, by which a rest pivoting position of the finishing tool is predetermined.

5. The device according to any claim 1, wherein the device comprises a cooling lubricant supply mechanism.

6. The device according to claim 5, wherein the cooling lubricant is active in one or more of a cooling and lubricating manner for the finishing machining of the internal face and is active as a sliding medium for the finishing tool displaceably arranged in the finishing tool receiver.

7. The device according to claim 1, further comprising a pressing mechanism, which loads the finishing tool with a pressing force to press an active face of the finishing tool against the internal face.

8. The device according to claim 7, wherein the pressing mechanism comprises a pressurized fluid to transmit a pressing force.

9. The device according to claim 8, wherein the pressurized fluid is a cooling lubricant.

10. The device according to claim 1, wherein the internal face is a track of a ball screw.

11. A method for the finishing machining of an internal face; comprising:

holding a workpiece on a workpiece holder;

holding a finishing tool on a finishing tool holder;

driving rotationally relative to one another about a rotational axis the workpiece and the finishing tool;

driving in a translatory movement relative to one another along the rotational axis the finishing tool and the workpiece, the translatory movement being in a direction parallel to the rotational axis;

driving in an oscillating movement relative to one another in the direction parallel to the rotational axis the finishing tool and the workpiece, the oscillating movement superimposed on the rotational movement and the translatory movement; and pivoting the finishing tool relative to the finishing tool holder about a pivot axis.

12. The method according to claim 11, wherein the internal face is a track of a ball screw.

* * * * *